United States Patent [19]

Dietrich

[11] Patent Number: 4,698,949

[45] Date of Patent: Oct. 13, 1987

[54] SELF-LEVELING BLOCK

[76] Inventor: Rodney J. P. Dietrich, 7 Raleigh Avenue, Scarborough, Ontario, Canada, M1K 1A2

[21] Appl. No.: 756,835

[22] Filed: Jul. 19, 1985

Related U.S. Application Data

[63] Continuation-in-part of Ser. No. 486,415, Apr. 19, 1983, abandoned.

[30] Foreign Application Priority Data

Jul. 19, 1984 [CA] Canada ..... 459268

[51] Int. Cl.[4] ..... E04B 2/02; E04C 2/04

[52] U.S. Cl. ..... 52/415; 52/596; 52/603; 52/604

[58] Field of Search ..... 52/396, 603, 607, 509, 52/596, 604, 415

[56] References Cited

U.S. PATENT DOCUMENTS

| | | | |
|---|---|---|---|
| 307,586 | 11/1884 | Phillips | 52/604 |
| 952,918 | 3/1910 | Mann | 52/603 |
| 966,226 | 8/1910 | MacQuesten | 52/603 X |
| 1,585,003 | 5/1926 | Wilson | 52/603 |
| 1,785,499 | 12/1930 | Sayers | 52/607 |
| 2,111,003 | 3/1938 | Petty | 52/603 |
| 2,348,314 | 5/1944 | Spalding | 52/509 |
| 2,472,221 | 6/1949 | Malthouse | 52/604 |
| 3,676,971 | 7/1972 | Dombroski | 52/603 |

FOREIGN PATENT DOCUMENTS

| | | | |
|---|---|---|---|
| 1154277 | 9/1983 | Canada . | |
| 1154278 | 9/1983 | Canada . | |
| 2203824 | 8/1973 | Fed. Rep. of Germany | 52/606 |
| 2104352 | 1/1974 | Fed. Rep. of Germany | 52/603 |
| 8300028 | 1/1983 | PCT Int'l Appl. | 264/162 |
| 591067 | 8/1947 | United Kingdom | 52/286 |

OTHER PUBLICATIONS

The American Builder Publication, Feb., 1933, p. 32, Sci. Lib. Cat. No. NA 1 A 35.

*Primary Examiner*—Alfred C. Perham
*Attorney, Agent, or Firm*—Riches, McKenzie & Herbert

[57] ABSTRACT

A modular building block is disclosed as is a mortar and block wall to be formed by a plurality of identical such building blocks stacked in rows in longitudinally overlapping relation with some surfaces of the blocks of one row in abutment with blocks of upper and lower rows, yet with cement mortar of a thickness suitable for a conventional mortar joint between the blocks. Through the provision of spacers of soft material coupled to the blocks, as an integral part thereof, to abut with harder body portions of the other blocks, the blocks can abut each other without interfering with the ability of the cement mortar to bond the blocks together absorbing contractive forces in the walls.

29 Claims, 19 Drawing Figures

SELF-LEVELING BLOCK

This application is a continuation-in-part of U.S. patent application Ser. No. 486,415, filed Apr. 19, 1983 now abandoned.

BACKGROUND OF THE INVENTION

The present invention relates to building blocks and more particularly to a novel modular building block for constructing masonry walls from a plurality of modular blocks.

In the past, conventional walls made of building blocks including concrete blocks and bricks have been constructed by locating one row of blocks on top of another row of blocks with a suitable bed of mortar therebetween. Leveling of such rows has the disadvantage of requiring the considerable skills of a mason in placing a suitable mortar bed and placing and tamping the blocks to provide a horizontal row typically with the assistance of a substantially horizontal stringline. Skill is required to ensure that mortar joints are provided having between a minimum and maximum thicknesses as is required under building codes and necessary for the wall to have acceptable strength. Variances in the mortar consistency create difficulties in maintaining proper mortar joint thickness. Conventional brick and block laying techniques are time consuming and expensive.

Conventionally laid block-and-mortar walls suffer the disadvantage that with the thickness of the mortar joint between blocks left to the skill of the mason, the effective vertical dimension of any course will vary. Typical building codes permit variances of joint thickness plus or minus $\frac{1}{8}$ inch. To locate courses at suitable heights for openings for doors, windows or ceiling locations it is conventional to vary joint thickness notwithstanding that the ideal strength of the wall is thereby somewhat impaired. With conventional wall construction the placement and location of the horizontal joints between blocks cannot be accurately predicted as, for example, would be advantageous to permit precise prefabrication of modular wall covering panels with preplaced anchors or ties to be embedded into horizontal mortar joints of the wall.

Conventionally laid block and brick walls suffer the disadvantages that as only the mortar between the blocks supports an uncured mortar-block wall, only a given number of rows can be laid at any one time and an uncured wall lacks substantial structural stability. Thus masons must wait for wet mortar to partially cure before laying additional rows and plumbers and other sub-tradesmen cannot lay and connect their fittings and related connections in view of the risk of the freshly laid wall sagging or collapsing.

Various proposals have been made to stack conventional blocks in abutting relation with each other to form walls. Abuttment of conventional blocks has major disadvantages. Firstly walls made of blocks are subject to considerable forces due to contraction and expansion of the wall in view of changes in temperature and changes in water content of the blocks (hydration). In walls made from conventional blocks in abutting relation, the blocks are unable to withstand localized forces which become focused on particular points. Walls made from abutting conventional blocks typically will fail due to cracking and crumbling of the blocks.

Another major problem with blocks which are stacked in abutting relation arises in climates where the wall may be exposed to freezing temperature. In such climates, some means must be provided to resist water penetrating into the wall and particularly to prevent water from accumulating between abutting portions of the blocks.

SUMMARY OF THE INVENTION

Accordingly, it is an object to at least partially overcome these disadvantages of the prior art by providing a self spacing and self leveling modular block to be stacked in abutting relation in the construction of mortar-block walls.

Another object is to provide a process for manufacture of the novel modular blocks in accordance with the present invention.

Another object is to provide a novel method of constructing a wall with the blocks of the present invention.

In a first of its aspects, the present invention provides a modular building block comprising a body portion with top and bottom support surfaces, interior and exterior lateral side surfaces and end surfaces, a first of said top and bottom surfaces comprising abutment surface means located in a first plane, spacer means coupled to the other, second of said top and bottom surfaces and extending therefrom to a second plane parallel to the first plane, the abutment surface means located on the first surface spaced inwardly from lateral side edges of the first surface, first mortar contacting areas on the first surface along the entire length of each lateral side of the first support surface laterally outwardly of the abutment surface means between the abutment surface means and each lateral side edge of the first surface, the spacer means located on the second surface spaced inwardly from lateral side edges of the second surface, second mortar contacting areas on the second support surface along the entire length of each lateral side of the second support surface laterally outward of the spacer means between the spacer means and each lateral side edge of the second surface, said body portion consisting of clay or cement concrete, said spacer means consisting of cured cement mortar, said spacer means having a compressive strength of at least 100 psi less than that of the body portion yet in the range of 400 to 1100 psi, said spacer means, abutment surface means, first mortar contacting areas and second mortar contacting areas being complementarily located on each block so that when identical said blocks are laid in rows in end-to-end relation with each successive row of said blocks stacked vertically on top of a preceeding row of said blocks in designed overlapping manner, the spacer means of each block of one row abut with abutment surface means of blocks of an adjacent upper or lower row to locate each block in said one row level with respect to the blocks of said adjacent row:

(a) with the body portions of each block in said one row spaced vertically from body portions of each block in said adjacent row, and (b) with the second mortar contacting areas of each block in said one row and the first mortar contacting areas of each block in said adjacent row spaced vertically by a substantially uniform vertical distance and forming therebetween a mortar joint space of an acceptable vertical height for a conventional cement mortar joint.

In a second of its aspects, the present invention provides a mortar and block wall comprising a plurality of identical modular building blocks, the blocks laid in end-to-end relation in longitudinally extending rows, each successive row stacked vertically upon a preceeding row, the blocks of each row in abutment with blocks of adjacent upper and lower rows, the blocks of each row in longitudinally overlapping relation with blocks in adjacent upper and lower rows, first cement mortar between each block and its adjacent neighbouring blocks to bond the blocks together, each modular block comprising a body portion with top and bottom support surfaces, a first of said top and bottom surfaces comprising abutment surface means located in a first plane, spacer means coupled to the other, second of said top and bottom surfaces and extending therefrom to a second plane parallel to said first plane, first mortar contacting areas on said first support surface extending along the entire length thereof, and second mortar contacting areas on said second support surface extending along the entire length thereof, said abutment surface means and spacer means being complementarily located on said first and second support surfaces, respectively of each block, whereby in said wall, abutment surface means of each block of each row abut with spacer means of blocks of an adjacent upper or lower row to locate blocks in each row level with respect to blocks of adjacent rows, said first and second mortar contacting areas being complementarily located on said first and second support surfaces, respectively of each block, whereby in said wall, the first mortar contacting areas of each block of each row are substantially uniformly vertically spaced throughout their areas a preselected distance from the second mortar contacting areas of blocks of an adjacent upper or lower row and form a mortar joint space therebetween, said first cement mortar filling said mortar joint space so as to provide a joint of cured, first cement mortar between blocks, said preselected distance comprising an acceptable vertical distance for a conventional cement mortar joint of said cured, first cement mortar, said spacer means consisting of cured, second cement mortar, the spacer means having a compressive strength less than or substantially equal to that of said cured first cement mortar, said body portion consisting of cured cement concrete, the body portion having a compressive strength greater than that of said cured first cement mortar.

In a third aspect, the present invention provides a method of use of block of the first aspect to build a mortar and block wall by stacking the blocks in rows in longitudinally overlapping relation comprising the steps of: (1) laying a first row of blocks with top support surfaces thereof facing upward and abutment surface means thereof all located in the same horizontal plane, (2) placing, on the one of the first and second mortar receiving areas on the top support surface, a layer of mortar extending above the top support surface a height marginally greater than the acceptable vertical height, (3) placing blocks for a second row in overlapping relation on the blocks of the first row with spacer means and abutment surface means of the blocks of the first and second rows in vertical alignment, (4) urging the blocks for the second row downward to compress the mortar layer until spacer means and abutment surface means of the blocks of the first and second rows abut locating the blocks of the second row in longitudinally level attitude with respect to blocks of the first row.

In a fourth aspect, the present invention provides a method of manufacture of the block of the first aspect comprising the steps of: (1) forming the blocks with the spacer means extending from the second support surfaces beyond the second plane, and (2) reducing the height of the spacer means to extend only to the second plane.

The modular building block of this invention permits the construction of a masonary wall from a plurality of the modular blocks to be bonded together with mortar. The blocks of the present invention permit blocks to be stacked with spacer means of each block to abut supporting surfaces of blocks in adjacent underlying or overlying rows. With the spacer means and first support surfaces of each block to lie in parallel planes and with the blocks stacked with spacer means of one block to abut the first support surface of adjacent blocks, the blocks are self-leveling. Such self-leveling blocks are readily stacked in abutting relation by a workman with substantial savings of labour. As a result of the blocks being self-leveling, each row of blocks necessarily will have substantially an exact pre-determined height. Furthermore, in stacking the blocks in abutting relation, top and bottom support surfaces of each block are self-spacing in the sense that mortar contacting areas on second support surfaces on one block are spaced substantially uniformly from first support surfaces of another block by a distance which corresponds to a desired width for a conventional mortar joint. Providing mortar joints of desired substantially constant width increases the strength of the resultant wall in that mortar joints which are too thin or too thick do not have maximum strength. Further, approximately constant mortar joint width throughout a wall provides increased strength through continuity.

The novel modular block in accordance with the present invention permits construction of an improved block and mortar wall with blocks are in abutting relation yet avoiding disadvantages of previously known walls with abutting blocks. Insodoing the block of the present invention provides a commercially viable block useful for stacking in abutting relation to thereby take advantage of the self-leveling and self-spacing features of abutting blocks.

Firstly, in order to provide a continuous layer spacing high strength portions of each block from high strength portions of all neighbouring blocks, each block in accordance with the present invention preferably has, firstly, a body portion with a high compressive strength and, secondly, spacer means coupled thereto. The spacer means have a compressive strength less than that of the body portion and approximately equal to or preferably less than that of cured mortar which is to bond the blocks together in a finished wall. The spacers space the high strength body portions from each other and in having a compressive strength comparable to that of cured mortar to bond the blocks together, do not interfere with the cushioning provided by the cured mortar in bonding the blocks to the other.

Secondly, to provide resistance to water penetration, the spacers preferably are located on each block spaced inwardly from lateral sides of the block which may exposed to weather. This lateral inward spacing of the spacer means defines mortar contacting areas laterally outward of the spacers between the spacers and the lateral sides running the entire length of the block whereby a continuous water resistant mortar joint may be formed therein between adjacent blocks.

The present invention in one embodiment provides for the use of soft cured cement mortar as spacers to space harder cement concrete body portions of the blocks. This has the advantage of permitting blocks to abut in a completed wall yet without interfering with the ability of mortar to form joints to bond the blocks together to absorb forces of compression and expansion acting on the wall. Such a block is advantageously made from well known building materials.

BRIEF DESCRIPTION OF THE DRAWINGS

Further objects and advantages of the present invention will appear from the following description taken together with the accompanying drawings in which.

DESCRIPTION OF THE PREFERRED EMBODIMENTS

Throughout the drawings like numerals are used to indicate similar elements.

Figure 1:
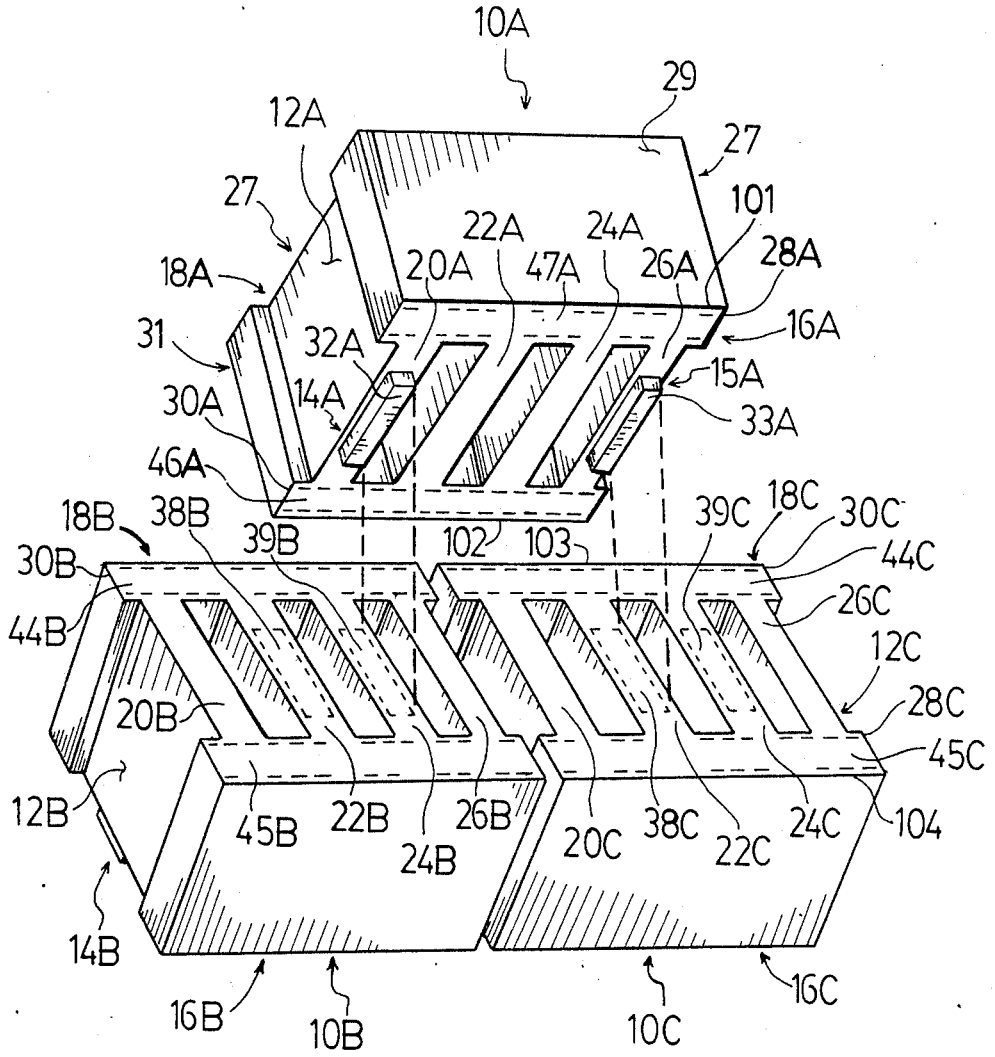
FIG. 1 shows pictorial representations of three identical concrete blocks in accordance with a first preferred embodiment of the present invention schematically depicting their intended juxtaposition in 50% overlapping relation when stacked in rows to form a wall.
Figure 3:
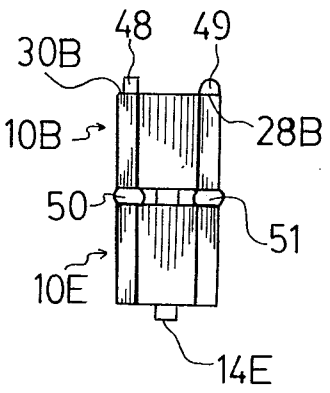
FIG. 3 shows a cross-sectional view along line III-III' of FIG. 2 but with mortar shown.
Figure 2:
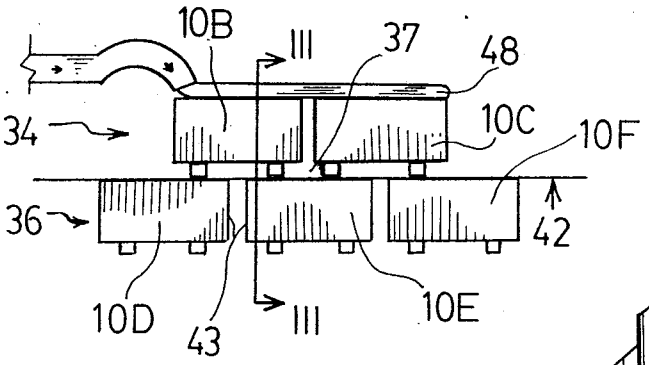
FIG. 2 shows a schematic side view of a portion of a wall constructed with five of the blocks of FIG. 1 and in which mortar between blocks is not shown.

Reference is made to FIGS. 1, 2 and 3 showing a first preferred embodiment in accordance with the present invention.

Each modular block 10 comprises a body portion 12 comprising a conventionally available concrete block to which spacers 14, 15 have been secured.

The body portion 12 has a planar top support surface 18 accurately lying in a first flat plane. The bottom support surface 16 of body portion 12, while substantially parallel to top surface 18 need not be accurately planar. Body portion 12 is shown with a plurality of ribs 20, 22, 24 and 26 which extend transversely of the longitudinally extending side wall portions 28 and 30. The block has lateral side surfaces 29 and 31 and end surfaces generally designated 27.

Spacer means or spacers 14, 15 in the preferred embodiment are shown as narrow rectangular bars secured to bottom surface 16, one centered transversely on each of ribs 20 and 26. While not apparent from the drawings the bearing surfaces 32, 33 of each spacers 14, 15 are accurately planar and lie in a second flat plane parallel to the first plane in which top surface 18 lies.

As seen in FIG. 2, blocks 10 are to be stacked end-to-end in rows with the blocks of an upper row designated 34 to be in 50% longitudinally overlapping relation with blocks in a lower row designated 36. As best seen in FIG. 1, with top surfaces **18*b* and 18*c* of blocks 10*b* and 10*c* lying in the same horizontal plane, the spacers 14*a*, 15*a* of block 10*a* and particularly bearing surfaces 32*a*, 33*a* thereof will abut with top surfaces 18 of blocks 10*b* and 10*c* and particularly abutment surface areas 29*b* and 38*c* thereon respectively (as shown in dotted lines on ribs 24*b*, 22*c*), by which abutment top surface 18*a* of block 10*a* will be accurately located in a horizontal plane parallel to the plane in which top surfaces 18*b* and 18*c* of blocks 10*b* and 10*c*** lie.

FIG. 3 illustrates the manner in which blocks 10 are adapted to receive and be bonded together with mortar to form a load bearing mortar and block wall. In known manner, as seen in FIG. 2 blocks **10*d*, 10*e* and 10*f* are to be secured with their top surfaces 18 in a single horizontal plane 42 and with mortar in the vertical spaces between their end surfaces generally designated 43. Uncured mortar may then be applied to the top surface 18 over mortar contacting areas designated 44, 45 and shown between dotted lines in FIG. 1 to overlie side wall portions 28 and 30 and extend along the entire length of each lateral side wall. FIG. 3 shows applied to block 10*b* layers of uncured mortar 48, 49 overlying each mortar contacting area 44, 45 prior to the placement of block 10*a* thereon. The mortar layers 48, 49 extend from surface 18 marginally greater than the height of spacers 14, 15 whereby on block 10*a* being placed thereon, mortar layers 48, 49 will be compressed between mortar contacting areas 44, 45 of top surface 18 and mortar contacting areas 46, 47 of bottom surface 16 (shown in dotted lines in FIG. 1) so as to permit bearing surfaces 32***a*, 33*a* to abut abutment surface areas 39*b*, 38*c*, respectively, with the upper block to assume the relative position shown for example by block 10*b* on block 10*e* in FIG. 3. As seen in FIG. 1, spacers 14 and 15 are spaced laterally inwardly from lateral side edges 101 and 102 of bottom surface 16 bordering lateral side surfaces 29 and 31 of the block. Mortar contacting areas 46 and 47 are located laterally outward of spacers. 14 and 15 between spacers 14 and 15 and the lateral side edges of bottom surface 16. Abutment surface areas 38 and 39 are spaced laterally inwardly from lateral side edges 103, 104 of top surface 18 bordering lateral side surfaces 29 and 31. Mortar contacting areas 44 and 45 are located laterally outwardly of abutment surface areas 38 and 39 between the abutment surface areas and the lateral side edges of top surface 18. On curing, mortar 50 and 51 form a conventional mortar joint to bond the blocks together along the entire length of the lateral sides of the blocks between mortar contacting areas 44, 45 and 46, 47.

The thickness of the mortar joints 50, 51 corresponds to the height the spacers 14, 15 extend beyond bottom surface 16, which height is selected so as to provide an advantageous mortar thickness to provide strength to the wall and satisfy building code requirements. The transverse dimension of the mortar joint 50, 51 may be suitably selected to provide desired strength.

In construction of a mortar and block wall with the block shown in FIGS. 1 to 3, care must be taken to ensure that the mortar layers 48, 49 applied to top surface 18 is not placed so as to become disposed between bearing surfaces 32, 33 of the spacers 14, 15 and abutment surface areas 38, 39 so as to prevent the desired leveling and height adjusting abutment therebetween. Transverse spacing of the mortar layers 48, 49 from spacers and the abutment surface areas assist in this regard in the first embodiment of FIGS. 1 to 3.

Block body portion 12 preferably consists entirely of either clay or cured cement concrete. Such cement concrete comprises mixtures of masonary cement and small rock aggregate and sand. Preferably concrete has, when cured, compressive strength greater than 800 psi and typically in the range of 1,000 to 2,000 psi. Suitable cement concrete is well known and widely used in conventional cement concrete blocks.

The mortar to bond the blocks 10 together and designated 48, 49, 50 and 51 in FIG. 3 is preferably conventional cement mortar as is well known and widely used in constructing conventional mortar-and-block walls. Such cement mortar comprises mixtures of Portland cement, sand and lime. Alternately it comprises masonary cement and sand. The mortar is applied wet between blocks and cures in place between the blocks. Preferred compositions of such mortar to bond the blocks together will have a compressive strength when cured less than that of the body portion, preferably at least 100 psi less than that of the body, portion yet in the range of about 400 to 1200 psi. With the mortar to bond blocks 10 together having a lower compressive strength than that of the block body portions 12, the mortar when cured will act as a cushioning layer between blocks to absorb compressive forces acting on the wall.

Spacers 14 and 15 preferably consist entirely of cured cement mortar similar to that to be used to bond the blocks 10 together. Spacers 14 and 15 may comprise cement mortar identical to the cement mortar to bond the blocks together. Advantageously the cured mortar to comprise the spacers will have a compressive strength which is not greater than the compressive strength of the cured mortar to bond the blocks together in a completed wall. The spacers may preferably be made from cement mortar having a compressive strength when cured at least 100 psi less than that of the body portion yet from about 200 psi to 1200 psi and more preferably, in the range of 400 to 800 psi. While it is preferred that the spacers have a compressive strength not greater than the compressive strength of cured conventional cement mortar to bond the blocks together, this is not necessary, provided the spacers also consist of cured conventional cement mortar. The spacers could therefore, for example, have a compressive strength of 1200 psi and the mortar to bond the blocks together have a compressive strength of 1000 psi.

In a completed wall in which the mortar to bond the blocks together has cured, with the body portions 12 having a compressive strength greater than that of cured mortar to bond the blocks together and with the spacers 14, 15 having a compressive strength in a comparable range to that of cured mortar to bond the blocks together, the abutment between spacers 14 and 15 of one block and upper surfaces of other blocks does not interfere with the ability of the cured mortar bonding the blocks together to provide a cured mortar joint to absorb contractive and expansive forces in the wall, for example, due to changes in temperature and hydration.

Preferably spacers 14 and 15 will be sufficiently strong that, in a wall constructed as described in association with FIG. 3 and before the mortar to bond the blocks together has cured, the spacers will support the weight of the wall. This provides the advantage that a wall, for example, of one or two stories of a building may be constructed without waiting for mortar to bond lower courses together to fully cure.

A novel mortar and block wall may be constructed from a plurality of identical modular building blocks 10 as shown in FIGS. 1 to 3 by laying the blocks in end-to-end relation in longitudinally extending rows with all of the blocks having the same one of top surface 18 or bottom surface facing upwardly. Successive rows are to be stacked vertically upon proceeding rows, with the blocks in each row in longitudinally overlapping relation with blocks in adjacent upper and lower rows. The blocks in one row are in abutment with blocks of adjacent upper and lower rows by means of the spacers 14 and 15 of each block in abutment with abutment surfaces 38 and 39 of adjacent blocks. The spacers 14 and 15 and abutment surfaces 38 and 39 are complementarily located on each block so that when placed in the wall in longitudinally overlapping relation, the abutment means and spacer means of adjacent blocks will abut to locate the blocks in each row level with respect to adjacent rows. Mortar contacting areas on the top surface 18 and mortar contacting areas on the bottom surface 16 of each block are complementarily located so that when the blocks are placed in the wall in rows, the mortar contacting areas 44 and 45 of top surface 18 of one block are substantially uniformly spaced throughout its surface area from the mortar contacting areas 46 and 47 of blocks of an adjacent upper or lower row and form a mortar joint space, designated as 37 in FIG. 2 therebetween. Uncured cement mortar, for example, 50 and 51 in FIG. 3 is to fill joint space 37 to provide on curing a joint of cured, first cement mortar between the blocks. The spacing between opposed mortar contacting areas defining joint space 37 is to be chosen to provide an acceptable vertical thickness for a conventional cement mortar joint.

While the wall is preferably constructed as described above in association with FIG. 3 by placing mortar 48, 49 on each mortar contacting layer prior to placement of a successive block thereon, a wall may be dry stacked using blocks 10 and thereafter uncured mortar placed as by pumping into joint space 37 to fill the same and cure therein.

In walls formed with conventional concrete blocks with all blocks spaced from its neighbours by mortar joints, compressive forces in the wall due to loading, thermal expansion or hydration are absorbed by the mortar joints which are of lesser compressive strength and to some extent compressible as compared to conventional concrete blocks. The mortar joints thus act as a cushion to absorb forces whereby mortar joints may become compressed to a small extent. For example, in a wall with $\frac{3}{8}$ inch mortar joints spacing conventional concrete blocks, the mortar joint may be compressed up to about 0.001 to 0.002 of an inch or more under normal design conditions.

In order that cured mortar 50, 51 in the joints separating the blocks 10 in FIG. 3 may function to absorb compressive forces, it is desirable that portions of each block which have a compressive strength greater than that of cured mortar 50, 51 be spaced from portions of all neighbouring blocks having a compressive strength greater than that of mortar by a distance greater than the maximum distance cured mortar 50, 51 in the joints between the blocks may be compressed due to forces normally acting on the wall. In this manner, body portions 12 of each block 10 will advantageously be prevented from contacting body portions of neighbouring blocks. Such contact if permitted may cause disadvantageous cracking or damage to the blocks.

Referring to the building block shown in FIG. 1, the desired separation is accomplished with the body portions 12 being substantially uniformly spaced one from another vertically by spacers 14 and 15 consisting entirely of mortar. In the case of FIG. 1, the body portions 12 of blocks in one row will be spaced from each other a distance substantially equal to the full height of the spacers. With the spacers comprising a height equal to that for an acceptable mortar joint, the body portion 12 may be seen to be spaced a distance substantially greater than the maximum distance the mortar joints between the blocks may be compressed due to forces normally acting on the wall.

Figure 12:
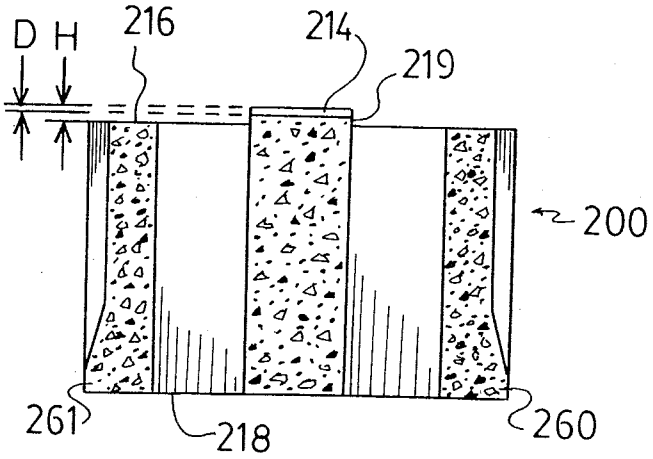
FIG. 12 shows a cross-sectional view along line XII-XII' of FIG. 11.
Figure 11:
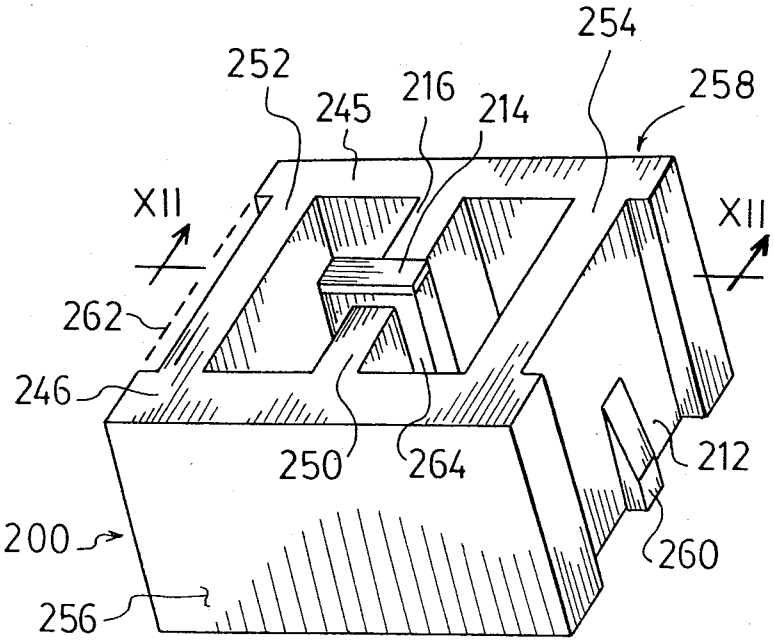
FIG. 11 shows a perspective view of a block of third embodiment of the present invention.

Reference is now made to FIGS. 11 and 12 which show another embodiment of a block in accordance with the present invention. As seen in FIG. 12 concrete body portion 212 includes an integral protrusion 219. Protrusion 219 comprises the same concrete as the rest of body portion 212 and may readily be formed at the time of formations of the body portion. The spacer means or spacer comprises an outer coating or layer 214 consisting entirely of a material such as cement mortar so that the spacer has a compressive strength less than or substantially equal to that of cured mortar to bond the blocks together in a wall. Protrusion 219 and outer spacing layer 214 together serve to space surfaces 216 and 218 of adjacent blocks when laid in a wall by a height H.

Outer layer 214 preferably has a thickness represented by D which is greater than the distance a conventional mortar joint of a thickness H may be compressed under expected compressive forces to act on a wall so as to prevent protrusion 219 from contacting surface 218 of an adjacent block under normal maximum conditions of compression of a cured mortar joint in a completed wall.

Advantageously, layer 214 will not only have a compressive strength less than that of cured mortar to bond the completed wall together, but will, without imparing the ability of the cured mortar to absorb contractive forces acting on the wall, compress a distance a conventional mortar joint of thickness H may be compressed under expected compressive forces to act on the wall. Outer layer 214 advantageously has sufficient strength to support the weight of a plurality of blocks stacked thereon prior to curing of mortar to be placed between rows of blocks.

While mortar contacting areas are to be spaced from each other by an acceptable width for a conventional mortar joint, other portions of the block which have a compressive strength greater than the mortar to bond the blocks together need only be spaced from each other by a distance greater than the maximum distance a cured mortar joint may compress under normal stresses acting on the wall. Abutting contact between neighbouring blocks preferably only occurs by means of spacers having a compressive strength less than or equal to the compressive strength of cured mortar to be used to bond the blocks together and with such spacers consisting of a layer of material with compressive strength less than that of cured mortar and of a thickness at least as great as the distance a conventional mortar joint may compress under conditions of normal stress acting on a wall.

Outer layer 214 may comprise materials such as cement mortar, plastic, plaster or rubber which may be readily applied, for example, as a coating, and may be made to be accurately located relative to surface 218.

Figure 18:
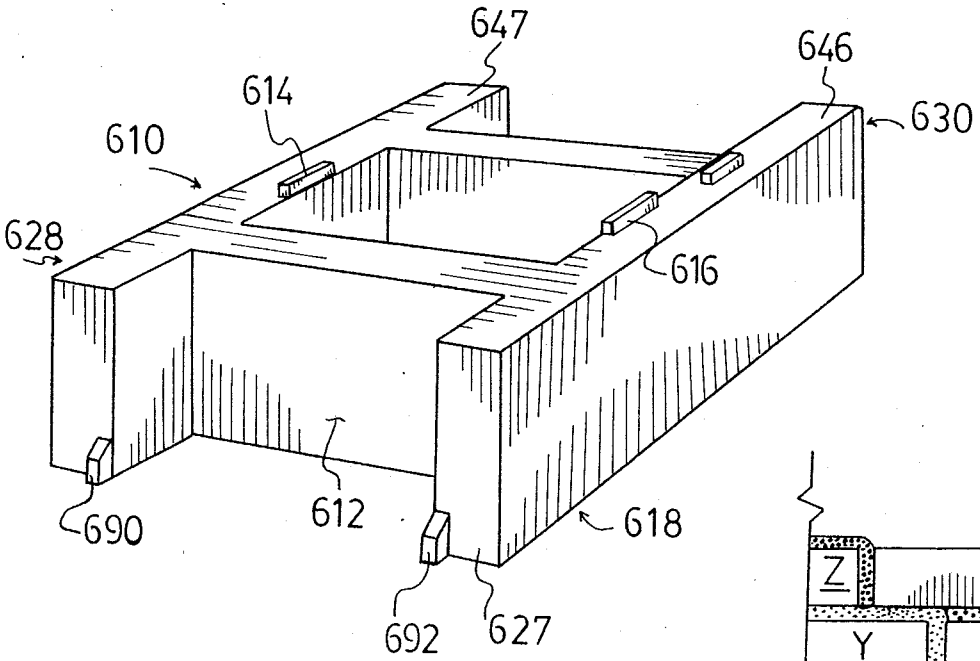
FIG. 18 comprises a perspective view of a block of a sixth embodiment of the present invention.

Reference is now made to FIG. 18 which is a perspective view of a block 610 in accordance with another embodiment of the present invention. In this embodiment, top spacers 614 and 616 are located on each longitudinally extending side wall portion 628 and 630 with mortar contacting areas 646 and 647 outwardly therefrom. Preferably top spacers 614 and 616 consist entirely of cured mortar secured to concrete body portion 612. Support surface 618 is accurately planar to abut with spacers of other blocks. Optionally, end spacers 690 and 692 may be provided entirely of cured mortar to accurutely abut with end surfaces 627 of an adjacent block thereby spacing end surfaces a distance suitable for a conventional mortar joint.

Figure 4:
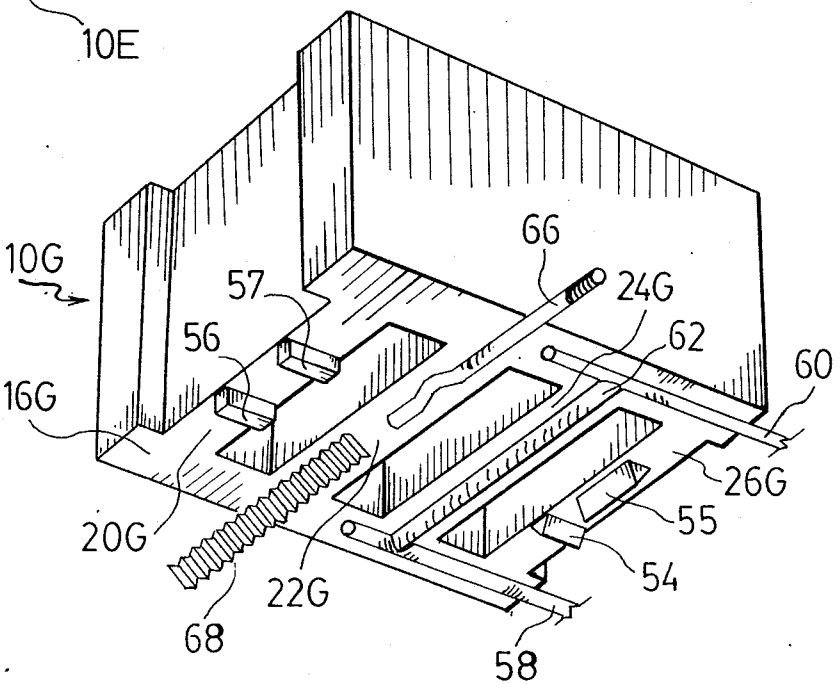
FIG. 4 shows a pictorial view of a block similar to that of FIG. 1 with alternate configurations for the spacer means and with reinforcing mesh, ties, and anchors schematically shown thereon.

Reference is now made to FIG. 4 which shows a block 10*g* similar to that of FIGS. 1 to 3 but modified to schematically illustrate alternative embodiments of the spacers. In FIG. 4, on rib 26*g*, two co-operating spacers 54, 55, are provided which taper downwardly from bottom surface 16 to a substantially sharp apex. Spacers such as spacers 54, 55 which have a small surface area to contact top surface 18 advantageously will penetrate wet mortar applied to the abutment surface areas 38, 39 to abut the same and provide the desired leveling and spacing. All the spacers on the block 10*g* could be provided with tapering spacers 54, 55. Spacer 54 is shown to extend longitudinally while spacer 55 is shown to extend transversely, Either orientation may be used exclusively or in combination with spacers of other configurations or orientations.

On rib 20g, two small rectangular spacers 56, 57 are shown. Four complementary such spacers could be used with two additional spacers similar to 56, 57 to replace tapering spacers 54, 55 at the location of spacers 54, 55.

As is to be appreciated rather than locate the spacers on ribs 20 and 26, with the block of FIG. 4 the spacers could be placed on ribs 22 and 24 and suitable 50% overlapping relation would result with abutment surface areas on ribs 20 and 26.

FIG. 4 shows a segment of a ladder-like reinforcing lattice 58 comprising longitudinal rods 60 and a plurality of regularly spaced transverse rods 62 only one of which is shown. Such lattice 58 may be provided to extend along the entire length of rows to increase wall strength. FIG. 4 shows that the spacers can be arranged on ribs 20, 26 so as to not interfer with transverse rods 62 which may overlie and become embedded in a mortar layer laid below rib 24.

Metal anchor 66 or metal tie 68 may also become embedded in a mortar joint between blocks by suitable application of mortar transversely below rib 22. The lattice 58, anchors 66 or ties 68 should, of course, have a thickness less than the height of spacers.

Figure 7:
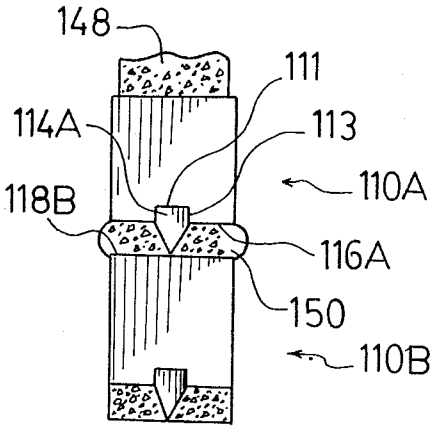
FIG. 7 shows a cross-sectional view along line VII-VII' of FIG. 6 but with mortar shown.
Figure 5:
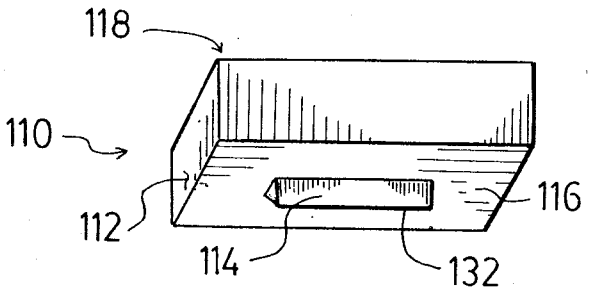
FIG. 5 shows a pictorial representation of a brick in accordance with a second preferred embodiment of the present invention.
Figure 6:
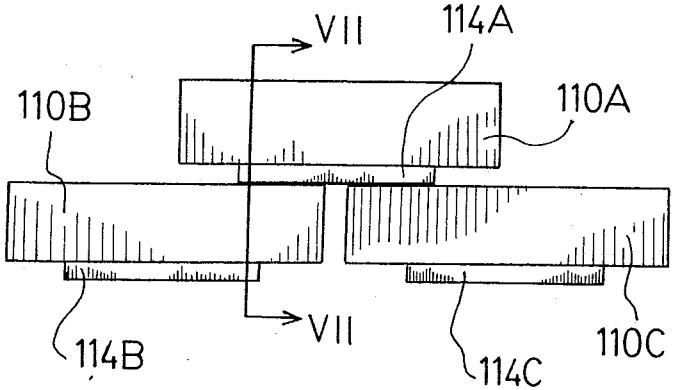
FIG. 6 shows a schematic side view of a portion of a wall constructed with three bricks of FIG. 5 and in which mortar between the bricks is not shown

Reference is now made to FIGS. 5, 6 and 7 which show a second preferred embodiment of a building component or block in accordance with the present invention. In FIGS. 5, 6 and 7, the block 110 comprises a body portion 112 which is a conventional solid brick modified so as to have a central longitudinal slot 113 in bottom surface 116 in which spacer 114 is secured and from which spacer 114 extends beyond bottom surface 116 tapering downward to a substantially narrow apex 132. The block 110 is formed with top surface 118 accurately lying in a first flat plane and apex 132 to lie in a second flat plane parallel to the first plane. In use, a layer of uncured mortar 148 may be applied to top surface 118 marginally thicker than the extension of apex 132 from bottom surface 116 as seen on the top block 110*a* in FIG. 6. When a block 110 is then applied to the mortar layer the tapering spacer will pierce through the mortar layer permitting the weight of the block and tamping to compress the mortar layer 148 and locate apex 132 in abutment with planar top surface 118. With apex 132 in abutment with planar top surface 118 the upper block 110 is aligned longitudinally level with the blocks of the underlying row. A workman can on placement and tamping of the upper block 110 position the same in a transversely level attitude whereby, the resultant mortar joints 150, 151 on either side of spacer 114 will have a thickness equal to the height of spacer 114.

Figure 8:
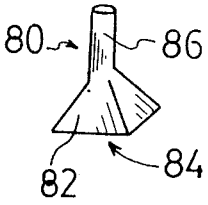
FIG. 8 shows a perspective view of a preferred spacer

Many shapes and configurations of spacers are suitable for use with the present invention. One preferred shape for a plastic spacer 80 is shown in FIG. 8 comprising a pyrimidal base portion 82 to provide a large lower surface 84 for bonding to a surface of a concrete block such as shown in FIG. 4 and a thin rod-like member 86 upstanding therefrom which can easily be cut after bonding to the concrete block to a desired height. An additional preferred embodiment is to provide blind bores in the second support surface of the blocks in to which thin rod-like spacer means may be secured.

The blocks may comprise many materials of construction. Preferably the body portion of the block may comprise well known masonary materials from which well known concrete blocks and bricks are made such as concrete, clay, light expanded clay aggregate and various mixtures thereof together with other various materials which may be incorporated therein. The spacers may be provided to be formed of the same preferred masonary materials as the body portion. Additionally the spacers may comprise other materials such as plastics notably polyethylene, polyvinylchloride and polystyrene, rubber, synthetic rubber, wood, glass, metal or hardened tar.

Whatever the mixture used for the body portion it is preferred that the spacers have sufficient strength to support the weight of a wall to be formed from the blocks before the mortar has cured. In many instances, preferably with the block shown in FIGS. 1 to 3, the spacers are desired to have sufficient strength to support the weight of a wall of substantial height to be quickly formed and while the mortar throughout the entire height of the wall is substantially wet. This is advantageous so that constructions of a wall made with such blocks may proceed without waiting for mortar in the lower rows to cure. With spacers so chosen, the wall has structural strength and integrity even while the mortar is substantially wet.

On the other hand, it is not necessary that the spacers be able to support such loads. For example, with the block shown in FIGS. 5 to 7 it may be advantageous to provide an inexpensive spacer of only sufficient strength for a workman to appreciate when the spacer is in abutment with the abutment surface areas. With a suitable mortar joint between the blocks, the mortar joint will substantially bear the weight of successive layers as the wall is built.

In selecting the compressive strength of the spacer, advantageously the spacer may have a compressive strength less than or comparable to the compressive strength of the mortar to be used to bond the blocks together. Further the spacer should have some resiliency in the sense of being able to absorb compressive loads as in the manner of a conventional mortar joint. This assists in letting the mortar bonding the blocks together act as a cushion in absorbing pressures generated in the wall in a conventional manner.

The spacer may comprise a separate element preferably secured to the block as in the manner of the spacers shown in FIGS. 1 to 3. Suitable bonding agents include rubber or plastic adhesives, epoxy, caulking compounds, tar, mortar and water and powdered cement mixtures. Other spacers may be directly secured to the brick, as for example by a polystyrene spacer of the shape shown in FIG. 8 injection moulded directly onto a bottom surface 16 of the block of FIGS. 1 to 3 whereby the spacer on solidifying integrally fuses itself to the bottom surface 16.

In the manufacture of blocks in accordance with the present invention one preferable method is to provide spacers suitably located on the blocks but extending from the block farther than that desired. The height of the spacer may then be reduced to the desired height. Where the spacers are made of cured cement mortar, the height reduction may be carried out by grinding. Where the spacers are made of plastic materials they may be cut off at the desired height by cutting means which may comprise an element sufficiently hot to melt the plastic material Thus, in the case of the blocks shown in FIG. 5 the blocks could be carried along a conveyor on their surface 118 with spacer 114 extending upwardly to be cut by a heated wire spaced on accurate height above the surface of the conveyor.

The blocks shown in FIGS. 1 to 3 may easily be manufactured from known masonary construction blocks. A process for manufacturing such blocks is to have an upwardly opening mould frame defining side and end surfaces with surface 18 of the block to be accurately formed by a bottom plate, typically a steel pallet, pushed upward against the mould frame. The mould is filled to a desired level with dampened cement and aggregate and compressed downward into the frame so as to form surface 16 roughly parallel to surface 18. The block is then removed from the mould to be cured for a period of time. To such blocks suitable spacers, may be secured. For example pre-cast and cured rectangular bars of hardened mortar of the shape of spacers 32, 33 in FIGS. 1 to 3, may be secured to a cured block with a thin layer of water and powdered cement. Preferred bonding results if both the block and bars are damp prior to forming the bond. Once mortar holding the bars onto the block has set, the tops of the bars may then be suitably ground to provide spacer abutment surfaces 32, 33 thereon.

Alternatively, onto a cured block or a block which is still substantially wet before curing, spacers of wet or cured mortar, may be secured to uppersurface 16 of the block preferably with a thin layer of a mixture of water and powdered cement therebetween. The height of uncured mortar spacers may be accurately adjusted before the spacer cures. One preferred method to reduce the height of a spacer of fresh, wet mortar is to move the block with spacer facing upwardly along a conveyor under a horizontally disposed continuously moistened roller extending transverse to the direction the block is moved and spaced a desired distance above the conveyor. An advantageous roller has an outer cylindrical surface of rubber-like material. Water is continually applied to the surface of the roller which is rotated at between 100 to 1200 rpm. With water continuously on the surface of the roller, the roller surface carries a thin continuous film of water and the spinning roller effectively "licks off" excess wet mortar from the spacer. A suitable shroud or casing may be placed about the roller closely received thereto to hold water and continuously wet the roller. The shroud may also collect and reduce spraying of the water and removed mortar. Use of the spinning, wet roller prevents mortar from sticking to the roller.

The block in accordance with the present invention may have separate body portions and spacers as for example in the case of blocks as shown in FIGS. 5 to 7 wherein the innermost surface 111 of slot 113 is precisely located parallel to surface 118 and spacer 114 is preformed of a desired height with both the base surface to contact surface 111 and apex 132 precisely parallel. Such a separate spacer may be located in slot 113 at a construction site. The spacers 14, 15 of the block shown in FIGS. 1 to 3 could also be suitably separable if their base portions and portions of surface 16 to receive the same are accurately located.

The block in accordance with the present invention lends itself to construction of walls wherein mortar is applied to successive rows of the blocks by pumping. With reference to the blocks shown in FIG. 3, a mortar pumping hose may be provided with a nozzle having two spaced extruding apertures one to overly each mortar receiving areas 28, 30. In this manner in a single pass of the nozzle, mortar layers 48, 49 of suitable consistent transverse dimension and height such as shown in FIG. 3 may quickly be placed on an uppermost row of blocks as in a manner similar to that toothpaste from a tube is placed on a toothbrush. Pumping of mortar is easier if a softened mortar consistency is used. The structural support provided by spacers 32, 34 assists in using a softened mortar yet obtain joints of desired thickness. A softened mortar or one containing, as an additive a, set retardant may also be required when pumping onto a long row of blocks so that the mortar may not dry excessively before application of the next row of blocks thereover. Separate mortar pumping hose nozzles may be used to pump mortar onto ribs 22 and 24 as seen in FIG. 1 as may be desired, for example, to receive reinforcing mesh 58, anchors 66 and ties 68 as seen in FIG. 4, The nozzles of the mortar pump may be designed to have the desired cross-sectional shape of the mortar layers 48, 49 and to extrude a bead of mortar to such shape at slow mortar volumetric flow rates through the nozzle. With mortar layers 48, 49 having constant height, breadth and consistency, it is much easier for a mason to maintain each block level end-to-end and face-to-face while he is lowering the blocks. Also, use of mortar layers 48, 49 as an accurately applied and controlled bead of uniform height and breadth assists in reducing wastage of mortar. By reducing excess of mortar, the oozing of excess mortar inwardly into a central cavity or outwardly into the exterior face of the block can be prevented preventing the need to remove the excess, which in the case of cavity walls with small inter-wall cavities or split rib blocks with decorative faces may be difficult.

Figure 19:
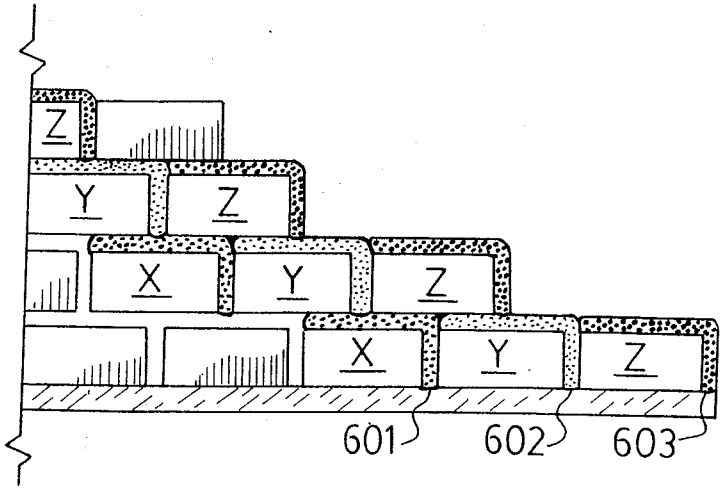
FIG. 19 shows schematically a side view of a portion of a wall comprising a plurality of different blocks in accordance with the present invention and a method of pumping mortar thereonto.

Reference is now made to FIG. 19 which shows a "staircase" method pumping mortar in conjunction with blocks in accordance with the present invention. In this method the wall is built up in a plurality of rows at once. As seen in FIG. 19, assume a wall has been built up to include blocks X with a bead of mortar 600 on the upper and right hand end surfaces thereof. Blocks Y are next laid thereon and a bead of mortar 602 is pumped onto the upper and right hand end surfaces of each block Y. Next blocks Z are laid and a bead of mortar 602 pumped into the upper and right hand end surfaces of each block. In this method each row must be of at least one and one-half blocks longer than the preceeding row. This method eliminates the need to pre-apply mortar to the ends of the blocks before laying the blocks.

Where it is desired to pre-apply mortar to the ends of blocks before laying, this can advantageously be done by placing a plurality of blocks with one of their ends on the ground near the wall with their other end facing upward. With these blocks lined up close together in line a substantially continuous bead of mortar can be pumped onto the end surfaces. Advantageously, the wall will be built row-by-row with, after laying of each row, a line of blocks for the next row will be lined up close-by the row. A person using a mortar pump may then pump a layer of mortar, onto the top of the laid row and onto the ends of the blocks for the next row in quick succession. As thinner mortar can be used with the blocks in accordance with the present invention, difficulties with pre-mature drying can be avoided.

Figure 16:
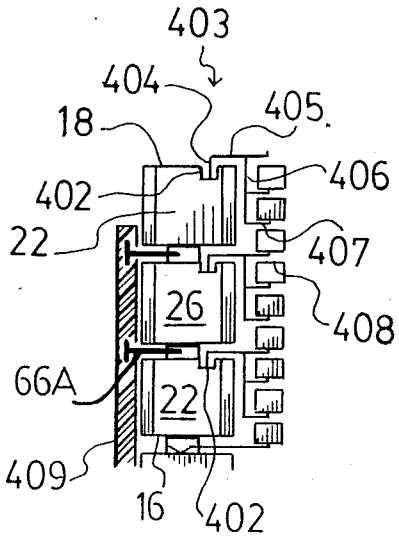
FIG. 16 shows an end cross-sectional view through a wall constructed of blocks similar to those shown in FIGS. 1 to 3 and with a wall covering panel attached to one side thereof and bricks shown coupled to the other side thereof and in which mortar is not shown.

The blocks of the present invention lead themselves to advantageous use in constructing a mortar-and-block wall which is to support wall covering panels to be secured to the wall by anchors placed in the horizontal mortar joints between rows of the blocks. For example, with the blocks shown in FIGS. 1 to 3 having spacers 32, 33 of a hardened conventional mortar, the spacers may have sufficient compressive strength to support the weight of a wall of substantial height constructed from said blocks even before the mortar has substantially cured and before the mortar has an initial set. By way of example, a wall at least of a height equal a single storey of a building to comprise the wall may be quickly constructed even while all the mortar in the wall has not yet set. In such wall, with the rows of blocks precisely spaced with respect to each other, the location of horizontal joints therebetween is accurately known in advance. A wall covering panel, for example of gypsum board, for example, to extend vertically to cover substantially the height of said single storey may be provided with a plurality of vertically and horizontally spaced panel fastening means or anchors. The panel may be located with its anchors in alignment with horizontal joints between the rows in the blocks and then pushed so as to cause the anchors to enter non set mortar joints. The structural stability of the wall may be sufficient to hold a plurality of such panels until the mortar has partially cured or the panel may be at least partially independently supported until the mortar has cured. Rather than have the anchors initially secured to the panels, the anchors may be preset in uncured joints and after the mortar has cured a panel 409 as seen in FIG. 16 attached to the anchors. The predetermined height of each horizontal joint permits modular panels to be constructed with preset anchor receiving means at suitable locations on the panel. The anchor receiving means may permit final accurate adjustment of the position of a panel with respect to the wall.

Such modular wall covering panels may comprise gypsum board, insulative material, wood, pre-cast concrete, metal, plastic or fiberglass, and may readily be applied to interconnect and cover a wall without special cutting to size.

As another advantage which results from the horizontal joints between blocks being accurated located at pre-determined heights, a second wall may be laid beside a first with the horizontal joints in each to accurately match and permit location of pre-set reinforcement or ties to tie the two walls together.

Figure 10:
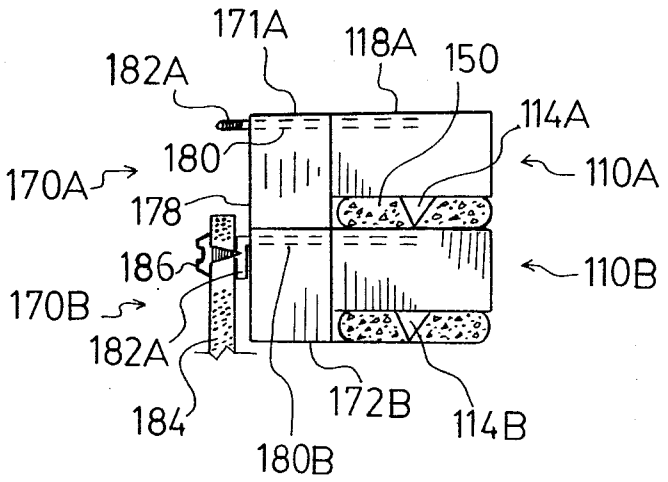
FIG. 10 shows an end view of two blocks of FIG. 9 stacked upon each other and an attached panel.
Figure 9:
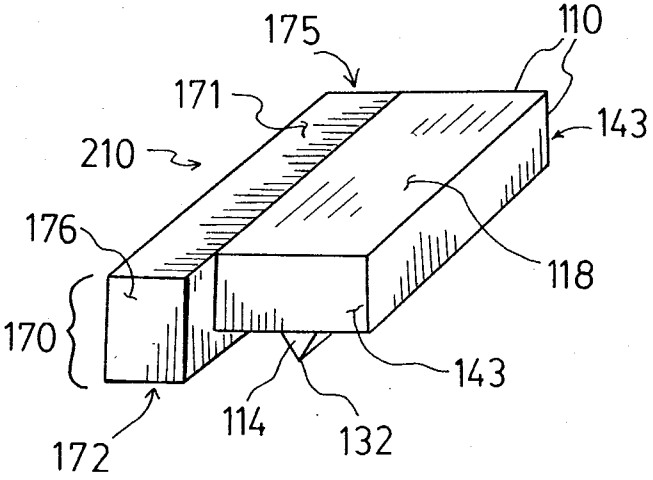
FIG. 9 shows, a pictorial view of a block of FIGS. 5 to 7 modified to include an insulating body.

Reference is now made to FIGS. 9 and 10 which show an illustrative embodiment of a composite block in accordance with the present invention. The composite block 210 comprises a block identical to block 110 shown in FIGS. 5 to 7 but modified so as to have a body 170 of insulating material secured to one lateral side thereof.

Insulating body 170 has an upper surface 171 formed to accurately lie in the plane of surface 118 of block 110. Lower surface 172 is formed to accurately lie in a plane parallel to the plane of surface 118 and including apex 132 of spacer 114. In a wall constructed from composite blocks 210, as seen in FIG. 10, lower surface 172 of body 170 of blocks in an upper row closely abuts upper surface 171 of a body 170 in a lower row. The insulative body 170 preferably has a longitudinal dimension equal to the length of block 110 plus a desired thickness of a vertical mortar joint between ends 143 of adjacent blocks 110 in the same row. In FIG. 9 this is shown with end 175 of insulating body 170 flush with one end 143 while end 176 extends beyond the other end 143 by the width of a desired vertical mortar joint. Alternatively the insulating body could extend beyond each end 143 a distance equal to one half the width of the mortar joint.

In construction of a wall from block 210, it is to be appreciated that a continuous insulative layer comprising top, bottom and end abutting insulating bodies 170 will be provided secured to a mortar-and-block wall comprising blocks 110 and mortar joints. In constructing the wall, abutment of the top and bottom surfaces of the insulating body 170 together with abutment of spacer 114 on surfaces 116 will provide for accurate location of the blocks 210 in one row in longitudinally level attitude and in transversely level attitude with respect to blocks 210 in another row.

The insulating body 170 may comprise materials selected from plastic foam, polyurethane, polystyrene, fiberboard, fiberglass, woodchips, plastic beads, vermiculite, hydite, leca, plant fibers and mineral wool. The insulating body should have a compressive strength less than that of the cured mortar to bond the blocks together.

The insulating body 170 may be secured to the block 110 by bonding agents or adhesives and by mechanical ties, as for example, anchors 180 driven through the insulating body into the block 110.

Preferably as shown in FIG. 10 with respect to block 110*a* ties 180*a* may extend with protrusion 182*a* marginally beyond the insulating body 170*a* to permit wall covering panels to be secured thereto. An insulating body 170*b* as shown in FIG. 10, a short segment 184 of such a wall panel is shown coupled by a fastening screw 186 to a widened modified end protrusion 182*b* of tie 180*b*.

A preferred method of manufacture of the composite block 210 is to secure an oversize body 170 to block 110 and then reduce body 170 to a desired size, possibly at the same time that spacer 114 may be suitably sized. In the case of plastic foam material such as polystyrene, body 170 may be injection moulded into a body portion 112 and at the same time spacers 114 injection moulded onto said body portion 110.

Reference is now made to FIGS. 11 and 12 showing a three rib hollow concrete block 200 having three ribs, a central rib 250, and two end ribs 252 and 254 extending between lateral wall portions, namely internal wall portion 256 and exterior wall portion 258. Mortar contacting areas overlie the top and bottom surfaces of wall portions 256 and 258 of which areas 245 and 246 are best shown.

Central rib 250 has a center portion 264 centrally located thereon between the wall portions which rib is of increased dimension in the end-to-end direction of the block as compared to the remainder of the central rib so as to reduce the amount of material required to make the central rib. Spacer 214 is provided on central portion 264 of the central rib. As with other embodiments surface 218 is accurately formed in one plane and the top of spacer 214 is provided in a plane parallel thereto.

Each end rib 252 and 254 is recessed from end surfaces of the wall portion and has a center portion 260 and 261, respectively, located thereon centrally between the wall portions which center portion has increased dimension in the end-to-end direction of the body portion compared to the remainder of each end rib. Each center portion on the end ribs tapers to reduce in end-to-end dimension from surface 218 towards surface 216 to reduce the amount of material required to make the end ribs. With surface 218 being accurately formed by a bottom plate in a mould and the block to drop downward out of the mould as seen in FIG. 12, tapering center portions 260 and 261 may readily be formed in a conventional mould to extend surface 18 towards the ends of the block.

The end-to-end dimensions of the center portion of the central rib and the center portions of the end ribs are to be chosen so that when identical blocks are stacked in rows in desired 50% longitudinal overlapping relation with a suitable thickness mortar joint between end surfaces of adjacent blocks in the same row, then each spacer 214 from one block will abut surface 218 on central portions of end ribs of two blocks in an adjacent upper or lower row.

FIG. 11 shows in dotted line 262 the edge of an end rib for a block in which the end rib is not recessed from the end surfaces of wall portions 256 and 258. In such a block center portions on the end ribs typically are not required.

The three rib block shown in FIGS. 11 and 12 minimizes the amount of material needed to make an overlapping block with but a single spacer means. If two spaces were to be provided, for example, centrally on each of end webs 252 and 254, central portion 264 on the central rib would provide an extended abutment area on surface 218 and could taper from surface 218 towards surface 216.

As shown in FIGS. 11 and 12, spacer 214 has a realtively small dimension in the side-to-side direction of the block. This is advantageous in permitting blocks to be laid in walls in abutting relation one with the other through the spacer means yet permitting minor adjustment by a person laying a block to ensure the wall is precisely vertical. In laying blocks in accordance with the present invention it is easy to lay the first row of blocks with a string line down one side of the row so that the blocks are in a straight, end-to-end horizontal row. It is difficult however to ensure that the side surfaces of each block are precisely vertical or as is referred to in this art face-to-face plumb. With the spacer 214 being located centrally between wall portions of the block, and with the spacers 214 having a small side-to-side dimension, a person laying a block on top of a mortar bed placed on a lower row can let abutment of spacers 214 give an accurate end-to-end level (in a longitudinal direction) with respect to the lower row yet to a minor extent manually adjust the block to be precisely face-to-face plumb (level in a transverse direction). Preferably a person laying blocks will monitor and check the vertical face-to-face plumb of every successive row laid.

The laying of blocks of FIGS. 11 and 12 so that they are accurately face-to-face plumb is greatly assisted when mortar placed on top of each successive row of blocks has a uniform consistency and size. Accurate beads of mortar as can be achieved by pumping assists a person laying a block to lower it, maintaining the block face-to-face plumb until the blocks abut each other. The combination of central narrow side-to-side dimension spacers and uniform pumped beads of mortar can greatly reduce the time and skill required to lay high quality walls.

Figure 14:
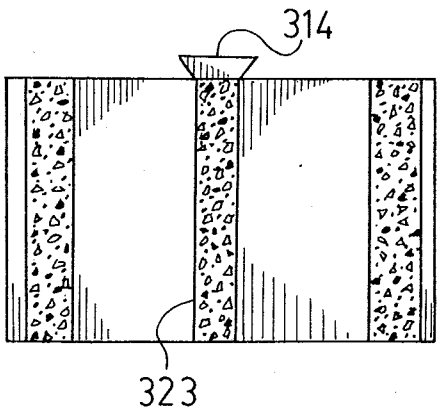
FIG. 14 shows a cross-sectional view along line XIV-XIV' of FIG. 13.
Figure 13:
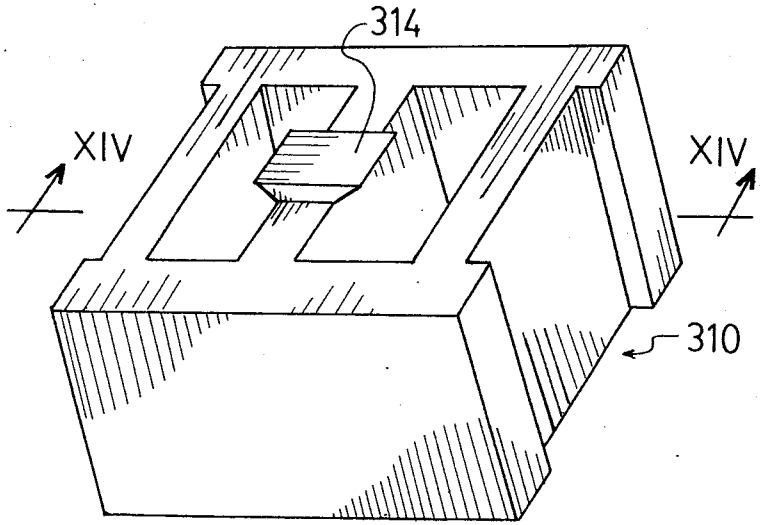
FIG. 13 shows a perspective view of a block of a fourth embodiment of the present invention.

FIGS. 13 and 14 show another three rib hollow concrete block 210 in which central rib 323 is of substantially uniform longitudinal dimension. Spacer 314 extends from rib 323 and is of a greater longitudinal dimension than rib 323 so that block 310, while having only 3 ribs, may be used in stacking in 50% overlapping relation.

While the block in FIGS. 11 and 13 have spacers with rather narrow transverse dimension, the transverse dimension may be increased as desired. With only 3 ribs, the blocks comprise less material than a 4 rib block. With only a single spacer, forming or grinding of the spacer is easier and less expensive.

Figure 15:
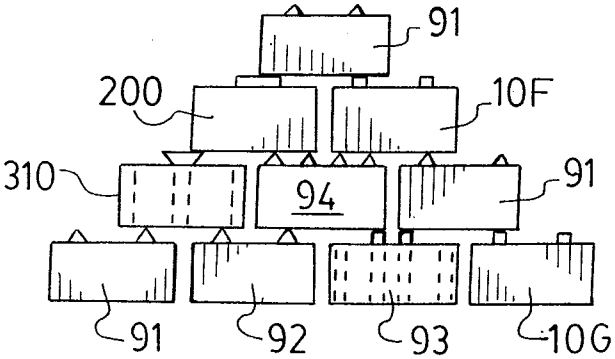
FIG. 15 schematically shows a side view of a portion of a wall comprising a plurality of different blocks in accordance with the present invention in which mortar between blocks is not shown.

FIG. 15 shows a side view of a portion of a wall made from a number of different but mutually compatable blocks in accordance with the present invention. Blocks 200 and 310 are three rib blocks as shown in FIGS. 12 and 14. Blocks **10*f* and 10*g* are similar to the blocks shown in FIGS. 1 to 3 but stacked with their spacers facing upward. Blocks 91 and 92 are blocks similar to the blocks of FIGS. 1 to 3 but with spacers which are, respectively, wedge-shaped and rounded in side view. Block 93 is a block similar to the blocks of FIGS. 1 to 3 but with the spacers located on ribs 22 and 24. Block 94** shows a block with four spacers.

FIG. 16 shows an end view of a wall constructed of blocks identical to the blocks of FIGS. 1 to 3 with the exception that longitudinally extending grooves 402 have been cut through the ribs so as to assist in receiving special anchors 403. Anchors 403 comprise a metal member bent so as to have an end 404 to extend into groove 402 and a flat portion 405 to become located within the horizontal mortar joint between blocks. A vertically downward extending portion 406 lies along one lateral side surface of the block and carries horizontally extending brick locating extensions 407. After a wall has been constructed with anchors 403 secured thereon, the anchors provide an accurate support upon which the lower surfaces of conventional bricks 408 may be located. The bricks are to be laid in rows with mortar therebetween with, on locating each brick on a mortar layer, extensions 407 providing an accurate support so as to locate the bricks in horizontal, accurately spaced rows. Of course, anchors 403 should be placed longitudinally spaced along a row of blocks so as to provide support for each brick to be laid.

FIG. 16 also illustrates a wall panel 409 to be secured to the block wall by anchors **66*a*** to be received in the horizontal mortar joint between blocks.

Figure 17:
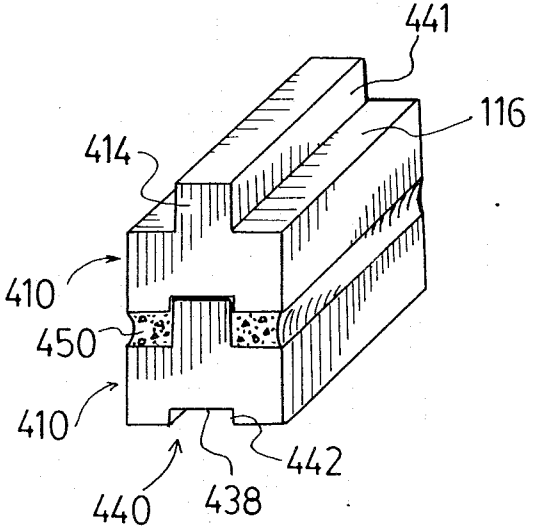
FIG. 17 shows a schematic perspective view of two self-aligning blocks in accordance with a fifth embodiment of the present invention.

FIG. 17 shows a simple brick-like block 410 in accordance with the present invention in which integral spacer 414 extends the entire length of the block on surface 116. The top of the spacer 414 lies in a plane parallel to the surface of recessed abutment surface area 438 in groove 440. With at least one lateral side surface 441 of spacer 414 and at least one side surface 442 of groove 440 accurately formed, the blocks 410 provide for vertical alignment as well as alignment in transversely and longitudinally level attitude. The height of mortar oint 450 is suitably determined by the vertical dimensions of spacer 414 and groove 440.

When used therein, the term block has a meaning including both blocks and bricks as these terms are known in this art.

Blocks in accordance with the preferred embodiments of the invention, when used in the construction of mortar and block walls, have the advantage of providing consistent height mortar joints between rows of blocks. For example, mortar joints 50, 51 seen in FIG. 3 can have a preselected height, preferably between $\frac{1}{4}$ and $\frac{5}{8}$ inches. The height of the mortar joint will practically speaking vary insofar as the actual height between surfaces 16 and 18 will vary in manufacture of the blocks of FIGS. 1 to 3. This variance however, can be made to be within acceptable tolerances to provide acceptable mortar joint height. The overall vertical dimension of each row of blocks may nevertheless be precisely constant.

The transverse dimension of the mortar joints 50, 51 as seen in FIG. 3 can also be selected by providing mortar receiving areas of suitable dimension transverse to the longitudinal. In this manner, building codes requiring transverse dimensions of $\frac{3}{4}$ to $1\frac{1}{4}$ inches for blocks of 6 to 12 inch width, respectively, can be satisfied.

In cases where building codes may require solid blocks with substantially 100% of the block surface bonded with mortar, embodiments such as shown in FIGS. 5 to 7, can satisfy these requirements.

Spacers in accordance with the present invention may be made of materials softer or harder than either or both the material of the block or the mortar. Pointed spacers as for example, shown in FIGS. 5 to 7 may advantageously comprise metal and be selected to withstand less compressive forces than the body portions. Optionally they may be stronger than the material of the block, for example, with the spacer to marginally extend into and become lodged into an adjacent block increasing strength of the wall but not cracking the wall, especially with interior walls which do not expand or contract.

In the case of side-to-side narrow centrally located spacers 214 as shown in FIGS. 11 and 12, the spacer may comprise a material which has a compressive strength greater than the body portion, particularly if the spacer 214 is relatively brittle and inelastic so that when exposed to forces larger than those it can withstand the spacer will crumble and cease to carry and loading forces. Such a brittle, high strength spacer could comprise a suitably composed cured mixture of cement and sand, for example, selected to have a compressive strength which is equal to that of the body portion or up to 500 psi greater than that of the body portion.

In the embodiment of FIGS. 1 to 3 abutment surface areas 38, 39 lie in the plane of surface 18. It is to be appreciated that these abutment surface areas may be suitably raised or lowered with respect to surface 18.

Although the description describes and illustrates preferred embodiments, it is not limited to these particular embodiments. Many variations and modifications will now occur to those skilled in the art. For a definition of the invention, reference is made to the appended claims.

What I claim is:

1. A modular building block comprising:

a body portion with top and bottom support surfaces, interior and exterior lateral side surfaces and end surfaces, a first of said top and bottom surfaces comprising abutment surface means located in a first plane, spacer means coupled to the other, second of said top and botton surfaces and extending therefrom to a second plane parallel to the first plane, the abutment surface means located on the first surface inwardly from lateral side edges of the first surface, first mortar contacting areas on the first surface along the entire length of each lateral side of the first support surface laterally outwardly of the abutment surface means between the abutment surface means and each lateral side edge of the first surface, the spacer means located on the second surface spaced inwardly from lateral side edges of the second surface, second mortar contacting areas on the second support surface along the entire length of each lateral side of the second support surface laterally outward of the spacer means between the spacer means and each lateral side edge of the second surface, said body portion consisting of clay or cement concrete, said body portion having a compressive strength greater than about 800 psi, said spacer means having a compressive strength at least 100 psi less than that of the body portion and in the range of about 400–1200 psi, said spacer means, abutment surface means, first mortar contacting areas and second mortar contacting areas being complementarily located on each block so that when identical said blocks are laid in rows in end-to-end relation with each successive row of said blocks stacked vertically on top of a preceding row of said blocks in designed overlapping manner, the spacer means of each block opf one row abut with abutment surface means of blocks in an adjacent upper or lower row to locate each block in said one row level with respect to the blocks of said adjacent row;

(a) with the body portions of each block in said one row spaced vertically from body portions of each block in said adjacent row, and (b) with the second second mortar contacting areas of each block in said one row and the first mortar contacting areas of each block in said adjacent row spaced vertically by a substantially uniform vertical distance and forming therebetween a mortar joint space of an acceptable vertical height for a conventional cement mortar joint, the spacer means on each block being located on the second surface aligned in a longitudinal, end-to-end direction of the blocm substantially centrally between the lateral side edges of the second surface and being relatively small in side-to-side dimension of the block thereby permitting marginal side-to-side pivoting of a block, relative to blocks it abuts in the imemdiately preceding row therebelow, about spacer means therebetween to facilitate orientatIon of the side surfaces of the block to be disposed accurately vertical, said body portion comprising lateral internal and external wall portions with three ribs extending therebetween comprising a central rib located centrally between end surfaces of the body portion and two end ribs proximate the end surfaces of the body portion, the spacer means consisting of a single spacer member located on said central rib centrally thereon between the wall portions, the abutment surface means located on each end rib centrally thereon between the wall portions.

2. A block as claimed in claim 1 wherein said spacer means have sufficient strength to support the weight of a plurality of blocks stacked thereon.

3. A block as claimed in claim 2 wherein said spacer means have a vertical thickness substantially equal to said substantially uniform vertical distance.

4. A block as claimed in claim 3 wherein said body portions of each block in said one row are spaced vertically from body portions of each block in said adjacent row by a distance substantially equal to said substantially uniform vertical distance.

5. A block as claimed in claim 4, wherein said first surface is planar and lies in said first plane, and said second surface is approximately planar and approximately parallel to said first plane.

6. A block as claimed in claim 4 wherein said spacer means extends from said second surface to taper to a narrow apex at said second plane.

7. A block as claimed in claim 5 wherein said spacer means extends from said second surface to taper to a narrow apex at said second plane.

8. A block as claimed in claim 1 wherein said spacer means has a compressive strength between 400 and 800 psi.

9. A block as claimed in claim 1 wherein said spacer means have a compressive strength less than that of cured, conventional cement mortar.

10. A block as claimed in claim 1 wherein said body portion comprises cured cement concrete.

11. A block as claimed in claim 1 wherein each end rib is recessed from end surfaces on said wall portions and includes a cnetral portion carrying the abutment surface means which extends from the end rib towards the end of the body portion nearest thereto.

12. A block as claimed in claim 1 wherein said spacer member on the central rib and the abutment surface means on the end ribs are complementarily located on the block so that when identical blocks are laid in rows in end-to-end relation with each successive row of blocks stacked vertically on top of a preceeding row of blocks in designed overlapping manner with spacing between end surface of adjacent blocks sufficient for a conventional cement mortar joint, the single space member on each central joint of one block in one row abuts with abutment surface means on end ribs of two blocks in an adjacent row.

13. A block as claimed in claim 1 wherein said single spacer member consists of cured cement mortar.

14. A mortar and block wall comprising:

a plurality of identical modular building blocks, the blocks laid in end-to-end relation in longitudinally extending rows, each successive row stacked vertically upon a preceding row, the blocks of each row in abutment with blocks of adjacent upper and lower rows, the blocks of each row in longitudinally overlapping relation with blocks in adjacent upper and lower rows, first cement mortar between each block and its adjacent neighboring blocks to bond the blocks together, each modular block comprising:

(a) a body portion with top and bottom support surfaces, (b) a first of said top and bottom surface comprising abutment surface means located in a first plane, (c) spacer means coupled to the other, second of said top and bottom surfaces and extending therefrom to a second plane parallel to said first plane, (d) first mortar contacting areas on said first support surface extending along the entire length thereof, and (e) second mortar contacting areas on said second support surface extending along the entire length thereof, said abutment surface means and spacer means being complementarily located on said first and second support surfaces, respectively of each block, whereby in said wall, abutment surface means of each block of each row abut with spacer means of blocks of an adjacent upper or lower row to locate blocks in each row level with respect to blocks of adjacent rows, said first and second mortar contacting areas being complementarily located on said first asnd second support surfaces, respectively of each block, whereby in said wall, the first mortar contacting areas of each block of each row are substantially uniformly vertically spaced throughout their areas a preselected distance from the second mortar contacting areas of blocks of an adjacent upper or lower row and form a mortar joint space therebetween, said spacer means on each block being located on the second surface aligned in a longitudinal, end-to-end direction of the block substantially centrally between lateral side surface of the block and being relatively small in side-to-side direction of the block to permit on laying of each block marginal side-to-side pivoting of a block relative to blocks it abuts about spacer means therebetween so that in said wall the blocks are orientated with side surfaces of each block disposed accurately vertical, said first cement mortar filling said mortar joint space so as to provide a joint of cured, first cement mortar between blocks, said preselected distance comprising an acceptable vertical distance for a conventional cement mortar joint of said cured, first cement mortar, the spacer means having a compresive strength less than or substantially equal to that of said cured first cement mortar, said body portion consisting of cured cement concrete, the body portion having a compressive strength greater than that of said cured first cement mortar, said body portion comprising lateral internal and external wall portions with three ribs extending therebetween comprising a central rib located centrally between end surfaces of the body portion and two end ribs proximate the end surfaces of the body portion, the spacer means consisting of a single spacer member located on said central rib centrally thereon between the wall portions, the abutment surface means located on each end rib centrally thereon between the wall portions.

15. The wall claimed in claim 14 wherein:

said abutment surface means are spaced inwardly from lateral side edges of said first support surface, said first mortar contacting areas extending along the entire length of each lateral side of the first support surface laterally outward of the abutment surface means between the abutment surface means and the lateral side edges of the first surface, said spacer means are spaced inwardly from lateral side edges of said second support surface, said second mortar contacting areas extending along the entire length of each lateral side of the second support surface laterally outward of the spacer means between the spacer means and the lateral side edges of the first surface.

16. The wall claimed in claim 15, wherein said spacer means have a vertical dimension greater than a maximum distance said joint of cured, first mortar may be compressed by forces normally acting on the wall.

17. The wall claimed in claim 16, wherein said spacer means have a vertical dimension substantially the same as the said preselected distance.

18. The wall claimed in claim 17 wherein the body portions of blocks in each row are spaced vertically from body portions of blocks of adjacent rows by a distance greater than a maximum distance said joint of cured, first mortar may be compressed by forces normally acting on the wall.

19. The wall claimed in claim 18 wherein all portions of each block,which portions comprise a material having a compressive strength greater than that of said cured, first cement mortar, are vertically spaced from all portions of other blocks, which portions comprise a material having a compressive strength greater than that of said cured first cement mortar, by a distance greater than a maximum distance said joint of cured first mortar may be compressed by forces normally acting on the wall 20. The wall claimed in claim 17 wherein said spacer means have sufficient strength to support the weight of a plurality of blocks stacked thereon so as to provide the wall with substantial load bearing capability prior to curing of said first cement mortar in said mortar joint space.

21. The wall claimed in claim 14 wherein said spacer means have sufficient strength to support the weight of a plurality of blocks stacked thereon so as to provide the wall with substantial load bearing capability prior to curing of said first cement mortar in said mortar joint space.

22. A wall as claimed in claim 14 further including panel fastening means in said first cement mortar in said mortar joint space to be securely retained therein at accurately located desired positions, the panel fastening means protruding from the mortar joint space on one side of the wall.

23. A wall as claimed in claim 22 further including substantially identical modular wall covering panels with coupling means located thereon at pre-selected desired positions and coupling the panels to the panel fastening means to support the panels on the wall.

24. A wall as claimed in claim 14 wherein said single spacer member consists of cured, second cement mortar.

25. A wall as claimed in claim 14 wherein said spacer member on the central rib and the abutment surface means on the end ribs are complementarily located on the block so that in said wall with identical blocks laid in rows in end-to-end relation with each successive row of blocks stacked vertically on top of a preceding row of blocks in designed overlapping manner with spacing between end surfaces of adjacent blocks sufficient for a conventional cement mortar joint, the single spacer member on each central rib of one block in one row abuts with abutment surface means on end ribs or two blocks in an adjacent row.

26. A modular building block comprising:

a body portion with top and bottom support surfaces, interior and exterior lateral side surfaces and end sufaces, a first of said top and bottom surfaces comprising abutment surface means located in a first plane, spacer means coupled tothe other, second of said top and bottom surfaces and extending therefrom to a second plane parallel to the first plane, the abutment surface means located on the first surface spaced inwardly from lateral side edges of the first surface, first mortar contacting areas on the first surface along the entire length of each lateral side of the first support surface laterally outwardly of the abutment surface means between the abutment surface means and each lateral side edge of the first surface, the spacer means located on the second surface spaced inwardly from lateral side edges of the second surfaces, second mortar contacting areas on the second support surface along the entire length of each lateral side of the second support surface laterally outward of the spacer means between the spacer means and each lateral side edge of the second surface, said spacer means, abutment surface means, first mortar contacting areas and second mortar contacting areas being complementarily located on each block so that when identical said blocks are laid in rows in end-to-end relation with each successive row of said blocks stacked vertically on top of a preceding row of said blocks in designed overlapping manner, the spacer means of each block of one row abut with abutment surface means of blocks in an adjacent upper or lower row to locate each block in said one row level with respect to the blocks of said adjacent row:

(a) with the body portions of each block in said one row spaced vertically from body portions of each block in said adjacent row, and (b) with the seocnd mortar contacting areas of each block in said one row and the first mortar contacting areas of each block in said adjacent row spaced vertically by a substantially uniform vertical distance and forming therebetween a mortar joint space of an acceptable vertical height for a conventional cement mortar joint, the spacer means on each block being located on the second surface aligned in a longitudinal, end-to-end direction of the block substantially centrally between the lateral side edges of the second surface and being relatively small in side-to-side dimension of the block thereby permitting marginal side-to-side pivoting of a block, relative to blocks it abuts in the immediately proceeding row therebelow, about spacer means therebetween to facilitate orientation of the side surfaces of the block to be disposed accurately vertical, said body portion comprising lateral internal and external wall portions with three ribs extending therebetween comprising a central rib located centrally between end surfaces of the body portion and two end ribs proximate the end surfaces of the body portion, the spacer means consisting of a single spacer member located on said central rib centrally thereon between the wall portions, the abutment surface means located on each end rib centrally thereon between the wall portions.

27. A block as claimed in claim 26 wherein said spacer means has a compressive strength less than that of cured, conventional cement mortar.

28. A block as cliamed in claim 26 wherein each end rib is recess from end surface on said wall portions and includes a central portion carrying the abutment surface means which extends from the end rib towards the end of the body portion nearest thereto.

29. A block as claimed in claim 26 wherein said spacer member on the central rib and the abutment surface means on the end ribs are complementarily located on the block so that when identical blocks are laid in rows in end-to-end relation with each successive row of blocks stacked vertically on top of a preceding row of blocks in designed overlapping manner with spacing between end surfaces of adjacent blocks sufficient for a conventional cement mortar joint, the single spacer member on each central rib of one block in one row abuts with abutment surface means on end ribs of two blocks in an adjacent row.

* * * * *